US010996633B2

(12) United States Patent
Monferrer et al.

(10) Patent No.: US 10,996,633 B2
(45) Date of Patent: May 4, 2021

(54) TIMEPIECE COMPRISING AN AUTOMATON WHICH IS ABLE TO REPRODUCE BEATING OF WINGS

(71) Applicant: Montres Jaquet Droz SA, La Chaux-de-Fonds (CH)

(72) Inventors: Bernat Monferrer, St-Prex (CH); Edmond Capt, Le Brassus (CH)

(73) Assignee: Montres Jaquet Droz SA, La Chaux-de-Fonds (CH)

( * ) Notice: Subject to any disclaimer, the term of this patent is extended or adjusted under 35 U.S.C. 154(b) by 547 days.

(21) Appl. No.: 15/920,749

(22) Filed: Mar. 14, 2018

(65) Prior Publication Data

US 2018/0267477 A1 Sep. 20, 2018

(30) Foreign Application Priority Data

Mar. 17, 2017 (EP) ..... 17161685

(51) Int. Cl.
*G04B 47/04* (2006.01)
*G04B 25/06* (2006.01)
*G04B 45/00* (2006.01)

(52) U.S. Cl.
CPC ..... *G04B 47/044* (2013.01); *G04B 25/06* (2013.01); *G04B 45/0038* (2013.01); *G04B 45/0046* (2013.01); *G04B 47/04* (2013.01)

(58) Field of Classification Search
CPC ..... G04B 25/06; G04B 45/0038–0061; G04B 47/04; G04B 47/044; G04B 47/048
See application file for complete search history.

(56) References Cited

U.S. PATENT DOCUMENTS 1,534,901 A 4/1925 Bonthoux
3,148,500 A * 9/1964 Hayes ..... G04B 45/0061 368/80

(Continued)

FOREIGN PATENT DOCUMENTS

CH 706 771 A2 1/2014
JP 2002-243013 8/2002

(Continued)

OTHER PUBLICATIONS

European Search Report dated Sep. 5, 2017, issued in European Application EP 17161685.7, filed Mar. 17, 2017 (with English Translation of Categories of Cited Documents).

*Primary Examiner* — Daniel P Wicklund
(74) *Attorney, Agent, or Firm* — Oblon, McClelland, Maier & Neustadt, L.L.P.

(57) ABSTRACT

A timepiece including a dial defining an XY plane, an automaton disposed above the dial, the automaton having at least one first member and one second member, which are articulated in order to reproduce beating movements, and a driving mechanism of the automaton. The first member is provided in order to pivot about a first axis which is non-parallel to the XY plane and the second member is provided in order to pivot about a second axis which is different from the first axis. The driving mechanism of the automaton includes actuators of the first and second members, provided in order to make the first and second members respectively pivot according to non-symmetrical pivoting movements and in order to coordinate the pivoting movements of the first and second members so that the combination thereof gives a beating effect of the first and second members.

19 Claims, 9 Drawing Sheets

(56) References Cited

U.S. PATENT DOCUMENTS

| | | | | |
|---|---|---|---|---|
| 4,421,421 | A * | 12/1983 | Bradt | G04B 45/0038 368/15 |
| 6,208,592 | B1 * | 3/2001 | Turner | G04B 19/042 368/223 |
| 7,969,824 | B2 * | 6/2011 | Wiederrecht | G04B 19/207 368/220 |
| 2008/0239884 | A1 * | 10/2008 | Muraji | G04B 47/044 368/232 |
| 2014/0307532 | A1 * | 10/2014 | Hartzband | G04B 45/0007 368/285 |
| 2014/0313868 | A1 * | 10/2014 | Takematsu | G04B 45/0038 368/232 |
| 2015/0205264 | A1 * | 7/2015 | Junod | G04B 45/0038 368/243 |
| 2016/0103422 | A1 | 4/2016 | Hartzband et al. | |
| 2017/0242400 | A1 * | 8/2017 | Denden | G04B 19/04 |
| 2018/0267477 | A1 * | 9/2018 | Monferrer | G04B 25/06 |

FOREIGN PATENT DOCUMENTS

| | | | | |
|---|---|---|---|---|
| WO | WO-2006036660 | A2 * | 4/2006 | G06Q 50/22 |
| WO | WO 2013/053906 | A1 | 4/2013 | |

* cited by examiner

TIMEPIECE COMPRISING AN AUTOMATON WHICH IS ABLE TO REPRODUCE BEATING OF WINGS

This application claims priority from European Patent Application No. 17161685.7 filed on Mar. 17, 2017, the entire disclosure of which is hereby incorporated herein by reference.

FIELD OF THE INVENTION

The invention relates to a timepiece comprising a dial, an automaton disposed above the dial, said automaton having at least one first and one second members, which are articulated in order to reproduce beating movements of said members, and a driving mechanism of said automaton. More particularly, the automaton can represent a butterfly, said first and second members forming the wings on both sides of the body of the butterfly.

BACKGROUND OF THE INVENTION

Such a timepiece is for example described in the Utility Model CN 202975610. The automaton in the form of a butterfly comprises two symmetrical wings which are articulated on each side along the same longitudinal axis forming the body of the butterfly. Each wing is actuated by its own mechanism, comprising a rod, provided in order to make each wing oscillate symmetrically relative to the body of the butterfly, between a high position and a low position relative to the dial. The wings are positioned such that, in low position, the wings are parallel to the dial and form, between them, an angle of 180°, in high position, the wings form respectively an angle of approx. 20° relative to the dial and therefore, between them, an angle of 140°. Positioning of the wings and also the driving mechanism thereof represents a high spatial requirement which makes it necessary to leave available a certain height above the dial. The timepiece must then have a certain thickness which can prove to be unaesthetic. When the wings, in low position, are parallel to the dial, the butterfly does not appear distinctly if the timepiece is viewed in profile. Furthermore, the driving mechanism comprising the double rod system can prove to be complex to manufacture then to synchronise and to be of a fragile constitution, in particular because of relative wear and tear of the components.

SUMMARY OF THE INVENTION

The object of the invention is in particular to remedy the various disadvantages of the known automaton mechanisms.

More precisely, one object of the invention is to provide a timepiece comprising an automaton which is able to reproduce the beating of two members, in order to simulate in particular beating of wings, which is compact and makes it possible to limit the thickness of said timepiece and also the surface occupied on the dial of the timepiece.

The object of the invention is likewise to provide a timepiece comprising an automaton which is able to reproduce the beating of two members, in order to simulate in particular beating of wings, which makes it possible to obtain very good efficiency and to have an instantaneous achieved torque which is constant and low.

To this end, the present invention relates to a timepiece comprising a dial defining an XY plane, an automaton disposed above the dial, said automaton having at least one first and one second member, which are articulated in order to reproduce beating movements of said members, and a driving mechanism of said automaton.

According to the invention, the first member is provided in order to pivot about a first axis which is non-parallel to the XY plane and the second member is provided in order to pivot about a second axis which is different from the first axis, and the driving mechanism of the automaton comprises actuation means of the first and second members, provided in order to make said first and second members respectively pivot according to non-symmetrical pivoting movements and in order to coordinate said pivoting movements of said first and second members so that the combination thereof gives a beating effect of said first and second members.

According to a particularly preferred embodiment, the automaton represents a butterfly comprising a lower wing, an upper wing and a body, the first member disposed nearest the dial representing the lower wing and the second member disposed furthest away from the dial representing the upper wing, said second member having a base which simulates articulation of the upper wing with the body of the butterfly.

This mechanism makes it possible, advantageously, to position the members of the automaton, and in particular the wings of the butterfly in a reduced volume. The invention consequently makes it possible to obtain a particularly compact automaton, which makes it possible to optimise the space which it occupies on the dial of the timepiece and not to impair the display surface available on the dial.

Furthermore, the positioning and also the different movements of the first and second members make it possible to obtain a livelier automaton, the beating being more realistic.

BRIEF DESCRIPTION OF THE DRAWINGS

Other features and advantages of the invention will appear more clearly upon reading the following description of a particular embodiment of the invention, given by way of simple example which is illustrative and non-limiting, and the annexed Figures, amongst which.

DETAILED DESCRIPTION OF A PREFERRED EMBODIMENT

Figure 1:
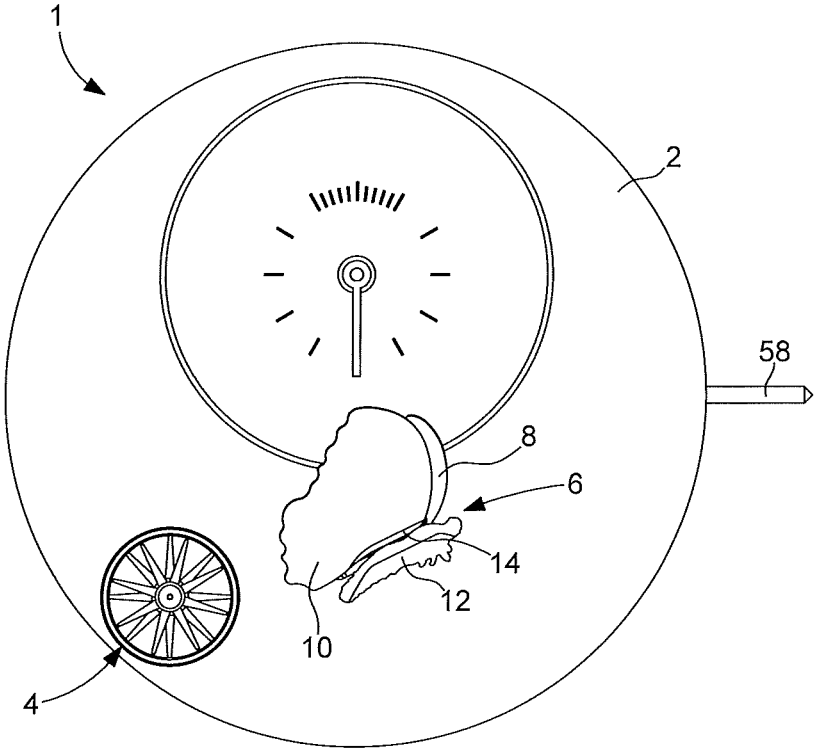
FIG. 1 is a schematic view from above of a timepiece according to the invention, the automaton representing a butterfly, the upper wing of the butterfly being in low position.

The present invention relates to a timepiece 1, for example a wristwatch, as represented in FIG. 1, and comprising a dial 2 on which, in a standard manner, there are represented various signs, such as the hour, the minute, the second or any other suitable sign. The dial 2 defines an XY plane.

On the dial 2, there are represented various animations, such as a wheel 4 and an automaton 6 comprising at least one first member 8 and one second member 10 which are provided articulated in order to reproduce beating movements by means of a driving mechanism. In the example described here, the automaton 6 represents a butterfly comprising a lower wing, an upper wing and a body 12, the first member 8 disposed nearest the dial 2 representing the lower wing and the second member 10 disposed furthest away from the dial 2 representing the upper wing, said second member 10 having a base 14 which extends substantially parallel to the longitudinal axis of the butterfly defined by the body 12 and simulates articulation of the upper wing with the body 12 of the butterfly. Thus, the butterfly is positioned on the dial as if it was "lying" on its lower wing. As FIGS. 1, 5, 9, 14 and 15 show, the first member 8 or lower wing is partially hidden by the second member 10 or upper wing so that the first member 8 has in fact substantially the form of a front wing of the butterfly, articulated at the level of its base 16. The butterfly here does not comprise a lower rear wing in order not to make the construction unwieldy and to free the space for the remainder of the mechanism. It is very evident that it is however possible to represent entirely the first member suitably as a function of the arrangement of the other elements of the mechanism. The second member 10 or upper wing has a form reproducing the upper front wing and upper rear wing of the butterfly.

As will be seen below, the lower and upper wings are articulated in order to reproduce the beating of wings of a butterfly, whilst the body 12 of the butterfly is represented fixed on the dial 2.

It is very evident that the automaton can represent a different animation, for example a different insect, a bird, etc., the wings of which are represented by the members 8 and 10, an animal or any other person having two articulated members which produce beating movements.

Figure 2:
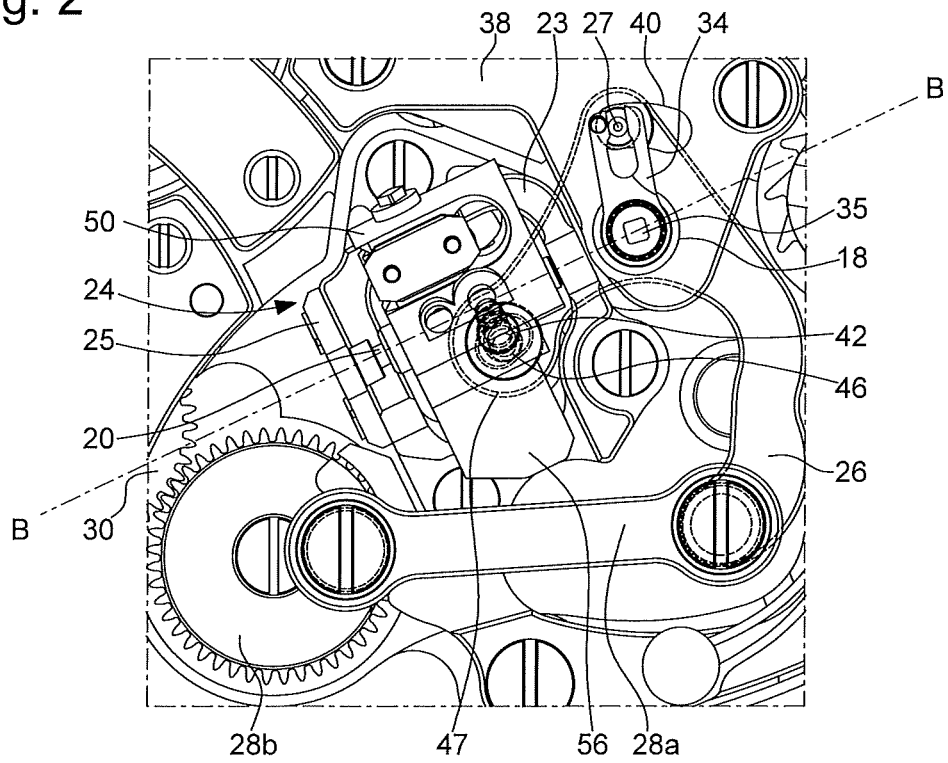
FIG. 2 is a view from above of the driving mechanism of the automaton according to the invention, when the upper wing of the butterfly is in low position.
Figure 3:
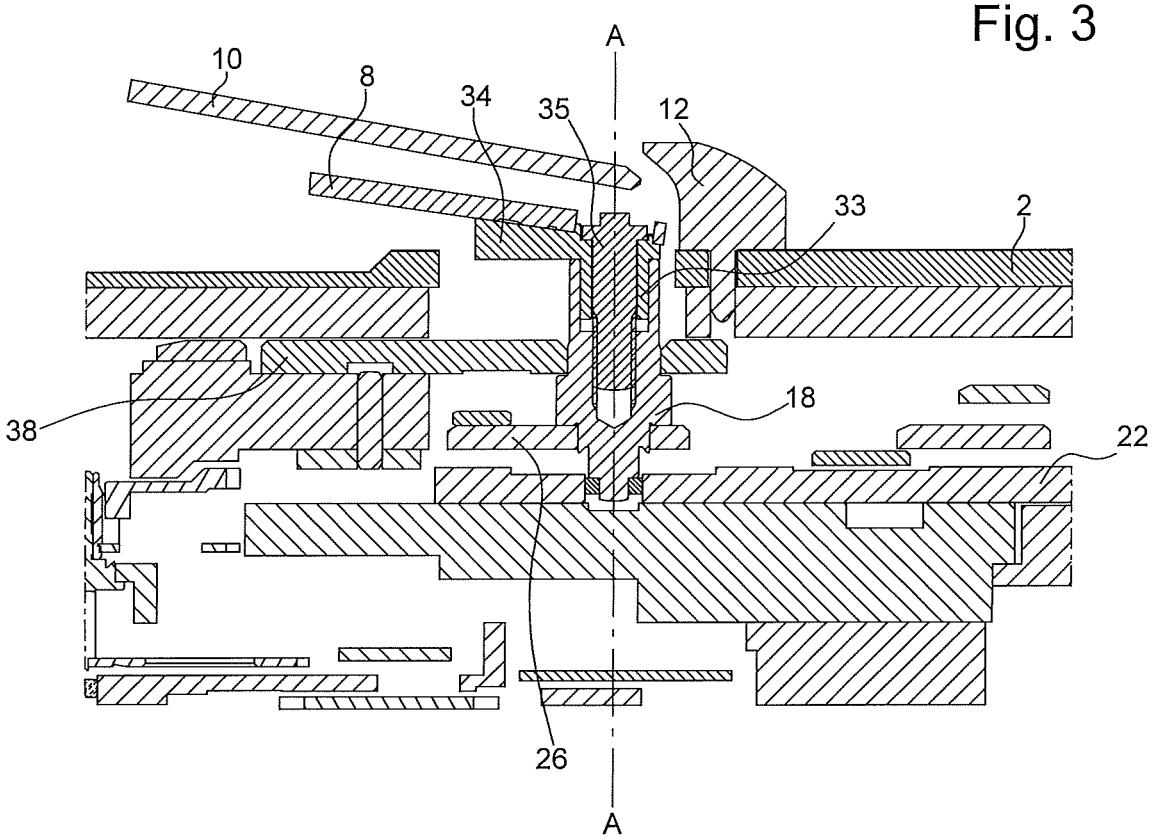
FIG. 3 is a sectional view of the mechanism at the level of the first axis when the upper wing of the butterfly is in low position.
Figure 4:
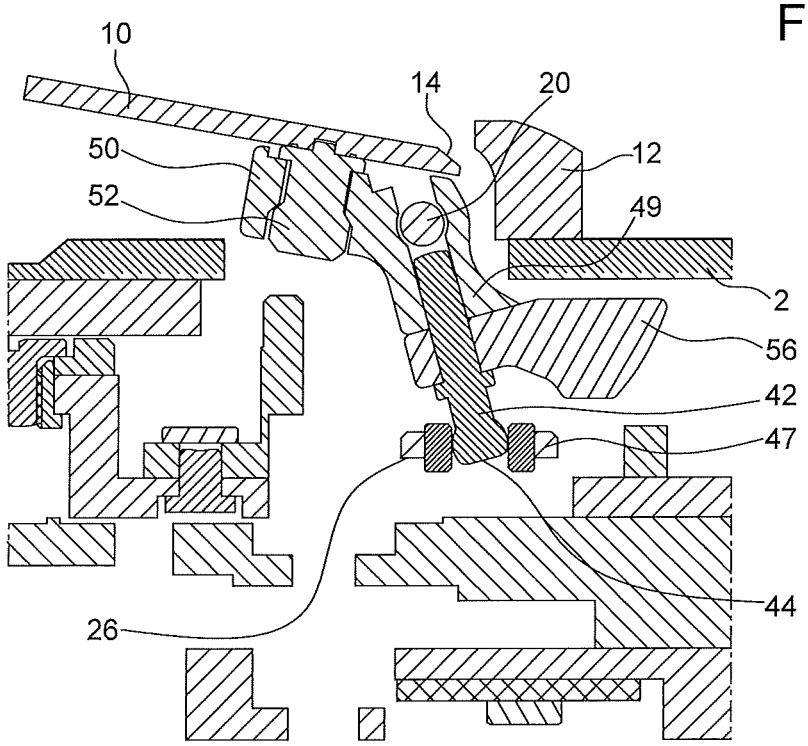
FIG. 4 is a sectional view of the mechanism at the level of the second driving stud when the upper wing of the butterfly is in low position.
Figure 18:
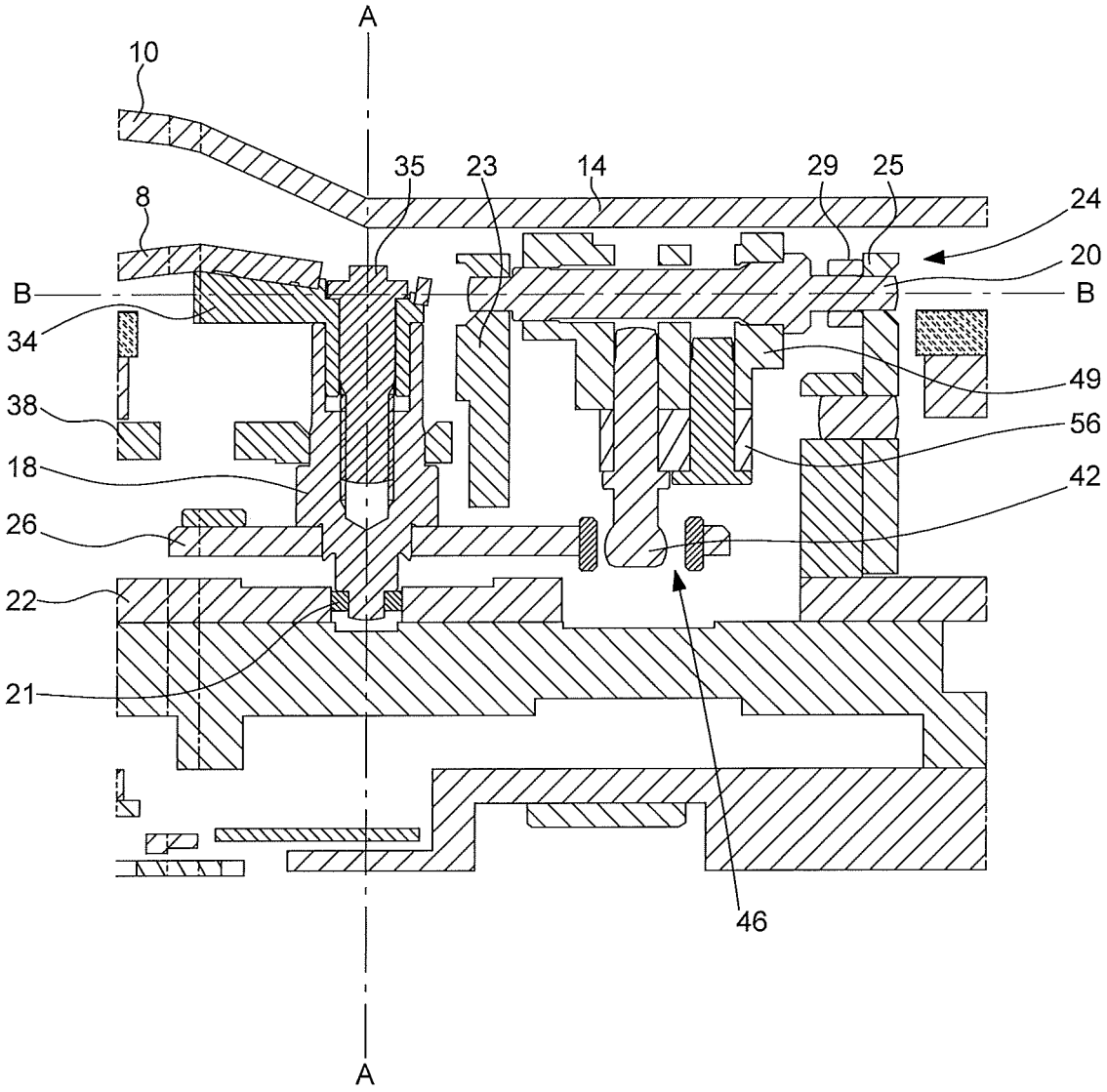
FIG. 18 is a sectional view of the mechanism along the second axis when the upper wing of the butterfly is in its intermediate position, more particularly and in a non-limiting manner, when the second driving stud is located in vertical position in the middle of its angular course.

According to the invention, and with reference more particularly to FIGS. 2, 3 and 18, the first member 8 is provided in order to pivot about a first axis AA which is not parallel to the XY plane of the dial 2 and the second member 10 is provided in order to pivot about a second axis BB which is different from the first axis AA.

Figure 13:
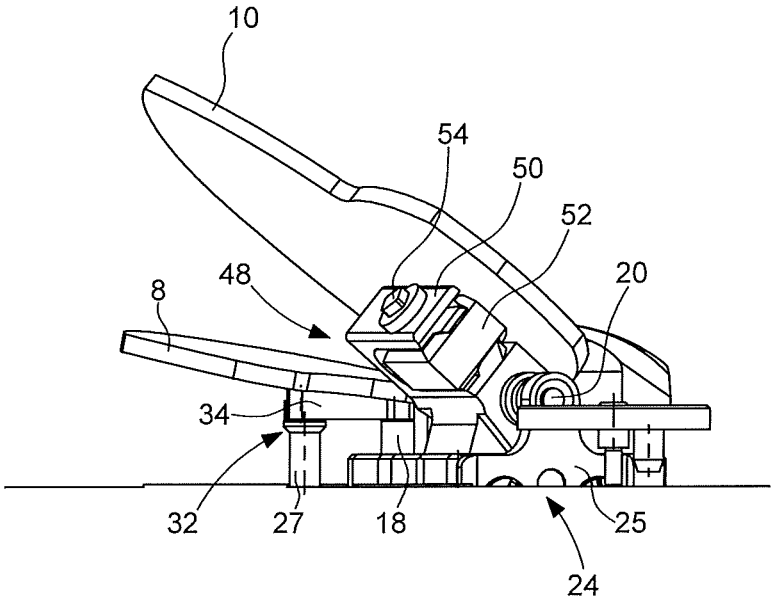
FIG. 13 is a perspective view of the profile of the automaton when the upper wing of the butterfly is in its high position.
Figure 14:
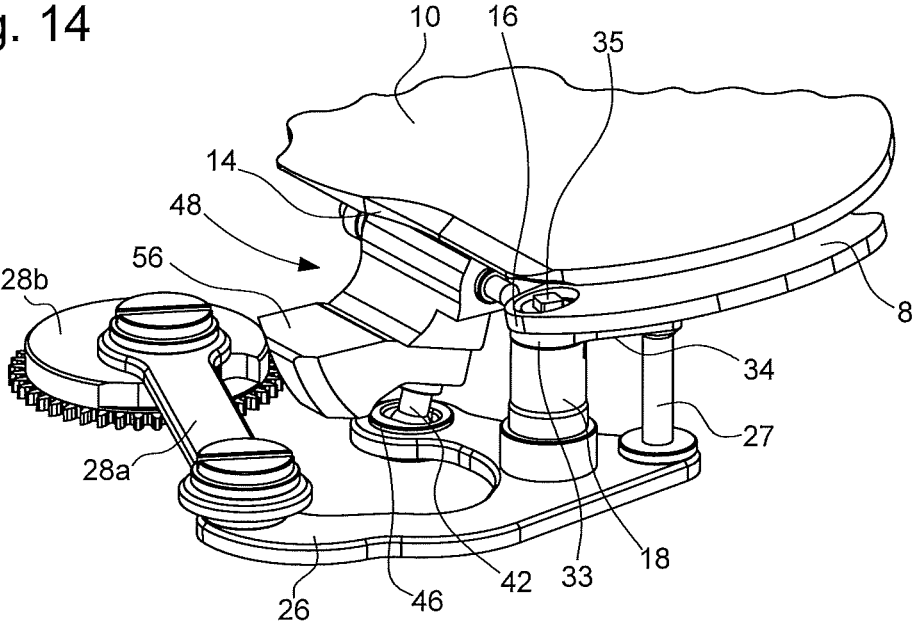
FIG. 14 is a perspective view of the automaton from the side of the lower wing.

Preferably, as represented in the described example, the first axis AA is perpendicular to the XY plane of the dial 2 and the second axis BB is positioned in a plane parallel to the XY plane of the dial 2, Furthermore, according to a particularly preferred embodiment as represented here, the first axis AA and the second axis BB are perpendicular and intersecting, disposed one relative to the other in such a way as to be able to position the first member 8 and the second member 10 in order to obtain an arrangement similar to that of the wings of a butterfly on both sides of the body 12. It is very evident that the positioning of the axes AA and BB can be adapted as a function of the position of the articulated members of the chosen animation. The axis AA about which the first member 8 pivots is produced by a first shaft 18 with axis AA, integral with the first member 8 and mounted to pivot between a frame element 22 and an intermediate bridge 38 (cf. FIG. 3, 18) of the timepiece. Control of the axial movement of said first shaft 18 is achieved by a pipe 21 which is advantageously driven on said frame 22. The axis BB about which the second member 10 pivots is the axis of a second shaft 20, integral with the second member 10, and mounted to pivot on a module 24 (cf. FIGS. 2, 13 and 18) fixed on the frame 22 of the timepiece. The module 24 is composed mainly of a module frame and a module bridge 25, said second shaft 20 being assembled to pivot according to the axis BB between the module frame 23 and the module bridge 25. Control of the axial movement of said second shaft 20 is achieved by a pipe 29 which is advantageously driven on said second shaft 20, it being given that, for reasons of spatial requirement, neither the module frame 23 nor the module bridge 25 have control means such as a jewel bearing, pipe, or any other control means. The second shaft 20 with the second member 10 and the module 24 are advantageously assembled independently and are positioned so that the base 14 of the second member is coaxial (parallel) to the second axis BB so as to simulate an articulation.

Furthermore, with reference to FIG. 2, the driving mechanism of the automaton comprises actuation means of the first and second members 8, 10 which are provided in order to make said first and second members 8, 10 pivot respectively according to non-symmetrical pivoting movements and in order to coordinate said pivoting movements of said first and second members 8, 10 so that the combination thereof gives a beating effect of said first and second members 8, 10.

More particularly, the actuation means of the first and second members 8, 10 are provided in order to make the first member 8 pivot in a plane perpendicular to the first axis AA, and in order to make the second member 10 pivot about the second axis BB and to make it oscillate between a low position and a high position relative to the dial 2.

Thus, only the second member 10 oscillates above the dial, which makes it possible to reduce the volume occupied by the members of the automaton in movement and to have compact automaton members. In a particularly advantageous manner, the second member 10 is provided in order to form, in its low position, an angle preferably less than 20°, and more preferably less than 10°, with the dial 2, and so that its course is less than or equal to preferably 40°, and more preferably less than or equal to 30°, thus forming, in its high position, a maximum angle of 40° with the dial 2.

Similarly, the first member 8 is provided so that its course is preferably less than 40°, more preferably less than 30°, so that its displacement likewise occupies a reduced volume.

With reference in particular to FIGS. 2, 14, 15, and 16, the actuation means of the first member 8 comprise a lever 26 which is provided in order to pivot about the axis AA, said lever being integral with the first member 8 in order to make the first member 8 pivot about the first axis AA during pivoting of the lever 26. To this end, the lever 26 is integral with the first shaft 18 which is mounted to pivot about the first axis AA, the first member 8 being fixed on the first shaft 18. More precisely, the first member 8 is fixed on a first member carrier 32 which is integral with the lever 26 and more particularly with the first shaft 18 which is mounted to pivot about the first axis AA. The first member 8 is fixed to the first member carrier 32 by its base 16 by gluing, soldering, welding, screwing, etc. Preferably, the first member carrier 32 comprises a pipe 33 which is mounted integrally and concentrically inside the first shaft 18 with axis AA, and fixed by means of a square-head screw 35. Use of a square-head screw makes it possible to limit the risks of chewing with a square screwdriver bit during assembly of the first member, compared with a flat bit. The first member carrier 32 likewise comprises a first clip 34 which is integral with the pipe 33, extending perpendicularly to the pipe 33 and on which the first member 8 rests. The surface of the first clip 34 in contact with the first member 8 is inclined in order to give the first member 8 the desired inclination. The first member 8 can be assembled for example by gluing, soldering, welding, screwing, etc. to this surface which is advantageously inclined in order to improve its retention.

Figure 15:
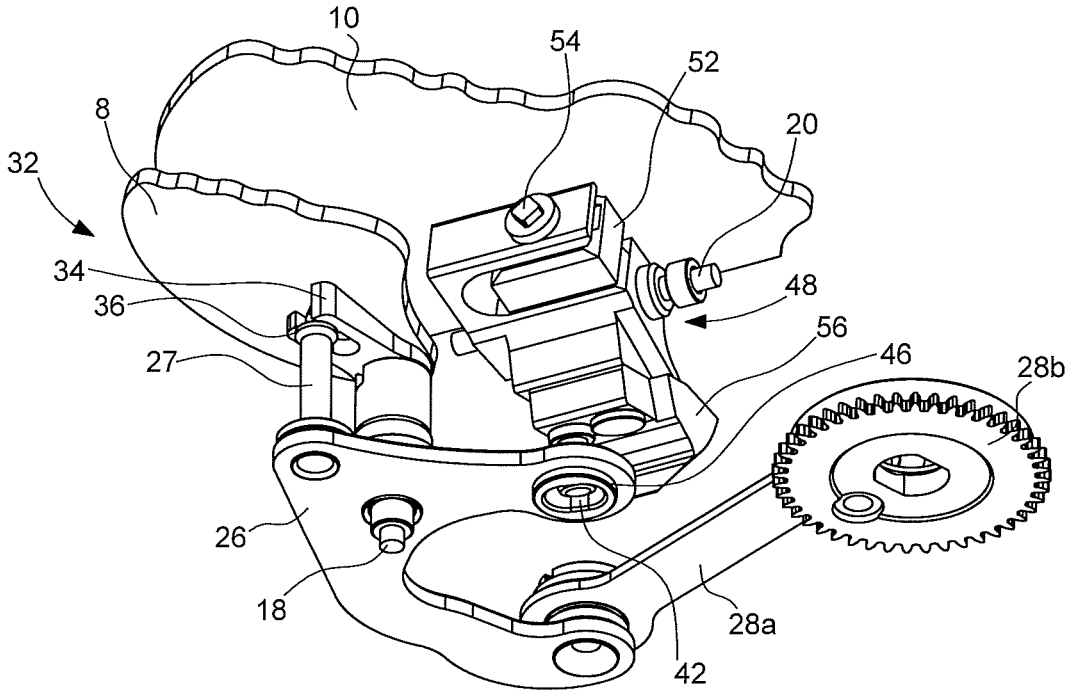
FIG. 15 is a perspective view from below of the automaton.
Figure 16:
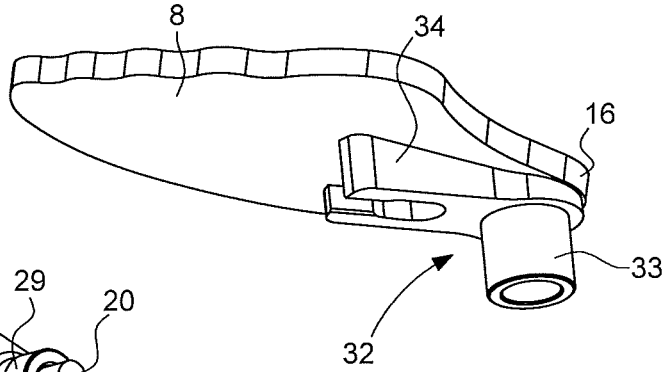
FIG. 16 is a perspective view of the first member carrier carrying the first member.

In order to ensure, over time, fixation of the pipe 33 of the first member carrier 32 in the first shaft 18, there is provided a first retention stud 27 which is parallel to the first shaft 18 with axis AA, and integral, on the one hand, with the lever 26 and, on the other hand, with the first member 8. For this, as FIG. 15 shows, the first retention stud 27 comprises, at its upper end, a shoulder 36 on which the ends of the first clip 34 rest so that the upper end projecting from the first retention stud 27 is caught by the ends of the first clip 34. This assembly makes it possible to confer a certain flexibility to the first clip 34, said clip 34 eliminating any possible play, and to be able to dismantle the assembly if necessary, without the restriction of the number of possible assembly/dismantling cycles. The lower end of the first retention stud 27 is fixed integrally to the lever 26 so as to pivot in one piece with the lever 26, the first shaft 18, the first member carrier 32 and the first member 8 about the first axis AA. The intermediate bridge 38 (cf. FIG. 2), parallel to the lever 26 and perpendicular to the axis AA, is passed through by the first shaft 18 and has an oblong opening or gap 40 in which the first retention stud 17 travels freely when it pivots with the lever 26 relative to the axis AA.

With reference more particularly to FIGS. 2, 14, 15 and 17, the actuation means of the second member 10 comprise a second driving stud 42, a first end of which is integral with the second member 10, as will be described hereafter, and provided in order to make the second member 10 oscillate between its low position and its high position (relative to the dial 2) about the second axis BB. To this end, the second driving stud 42 comprises, at a second end, a sphere 44 which is provided to be mounted by a spherical linkage in a gap 46 provided on the free end 47 of the lever 26, and on which the sphere 44 can roll so as to make the second member 10 oscillate about the second axis BB during pivoting of the lever 26 about the first axis AA.

With a transmission of this type, the torque losses are very small for two reasons: a restrained angle of oscillation of the second driving stud 42, less than ±15°, and the absence of a restoring spring thanks to reduced play between the parts which make up the linkage.

Figure 17:
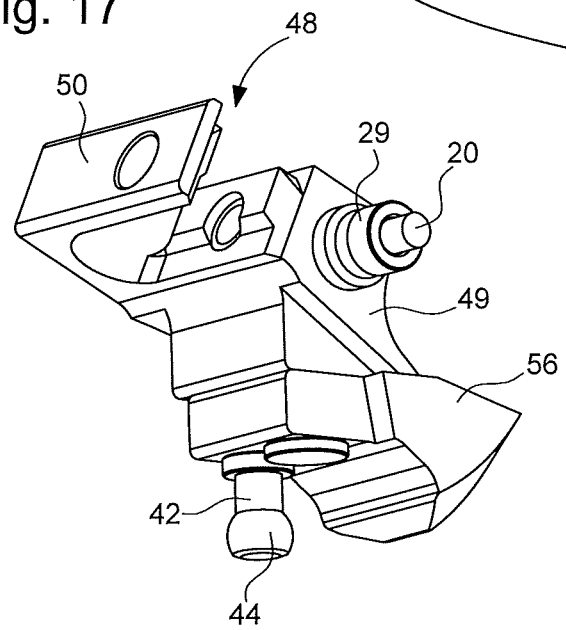
FIG. 17 is a perspective view of the second member carrier with the second driving contact.

More precisely, as FIG. 17 shows, the second member 10 is fixed on a second member carrier 48 which is integral, on the one hand, with the second shaft 20 and, on the other hand, with the second driving stud 42. To this end, the second member carrier 48 comprises a socket 49 in which the second shaft 20 is fixed, for example by driving, according to the axis BB, and in which there is likewise fixed the first end of the second driving stud 42, perpendicularly to the second shaft 20. Thus, when the second shaft 20 is mounted to pivot, integral with the second member carrier 48, about the second axis BB on the module 24 and when the second end of the second driving stud 42 is mounted in the lever 26 by a spherical linkage, the pivoting of the lever 26 about the first axis AA drives the pivoting of the second member carrier 48 about the second axis BB.

Said second member carrier 48 likewise comprises a second clip 50, integral with the socket 49 and on which the second member 10 is mounted. To this end, the second member 10 has, on its lower face, a fastening 52 of a shape which is complementary to the second clip 50 and provided in order to be able to slide in the second clip 50 and to be housed there. This assembly makes it possible to confer a certain flexibility to the second clip 50 and to be able to dismantle and reassemble, at wish, the assembly if necessary. The socket 49 has inclined faces so as to give the second member 10 the desired inclination. Furthermore, the second member 10 can be assembled for example by gluing, soldering, welding, screwing to this advantageously inclined surface in order to improve its retention. The second member 10 is mounted in the second clip 50 such that its edge 14 is parallel to the second shaft 20. The fastener 52 is fixed to the second clip 50 by means of a square-head screw 54. Use of a square-head screw makes it possible to limit the risks of chewing with a square tip screwdriver bit during assembly of the second member, compared with a flat tip.

Furthermore, the second member carrier 48 carries a counterweight 56. This counterweight 56 comprises a socket assembled under the socket 49 of the second member carrier 48 so that it is passed through by the second driving stud 42. The object of the counterweight is to balance the second member carrier 48 and to avoid a very high imbalance during oscillations or changes in orientation of the wristwatch, inevitably subjected to these variations.

Advantageously, the lever 26 is actuated by a connecting rod device 28*a*, 28*b* which is provided in order to transform a continuous circular movement of a mobile part 30 of the timepiece into an alternating circular movement. This connecting rod device is known to the person skilled in the art and requires no detailed description. It is very evident that any other mechanism which makes it possible to make the lever 26 pivot and oscillate about the first axis AA of the first shaft 18 can be used.

In the example described here, the same lever 26 is used advantageously in order to make the two members 8 and 10 pivot. It is very evident that it is possible to provide two systems for pivotal driving of the first and second members 8, 10 provided in order to allow said members 8, 10 to pivot independently, and to obtain combined movements which are equivalent to the mechanism described in the present example.

The automaton 6 and also the wheel 4 can be supplied with power by autonomous power accumulators, independent of the power accumulator of the movement. The wheel 4 is driven in as if it concerned a needle on the pinion of an idle wheel and can be driven by an independent spring barrel, its speed being regulated by a regulator. Advantageously, the automaton 6 and the wheel 4 can be set in motion and stopped by an actuation mechanism which is independent of the movement of the timepiece. The wheel 4 turns on itself simultaneously with the animation of the automaton 6. According to another variant, the wheel 4 can be driven continuously with the base movement.

According to one possible embodiment variant, this actuation mechanism comprises a push crown 58 provided with a push button STOP & GO which allows action (GO) and stoppage of the automaton (STOP) on demand by the user. The actuation mechanism of the automaton likewise comprises a wheel with columns, positioned at rest by an anti-return catch spring, cooperating, on the one hand, with a lever actuated by the push button and, on the other hand, with a blocking lever provided in order to block the connecting rod device. The actuation mechanism is provided so that the blocking lever locks the automaton as soon as it presses against a wheel with a specific profile, with a hard point, prioritising stoppage when the second member reaches the low position thereof. Thus, once the STOP position is locked, the current beating continues until the second member of the automaton is in low position.

The operation of the automaton according to the invention is the following: upon stoppage, the elements of the automaton occupy the positions illustrated by FIGS. 1 to 4. The lever 26 is positioned so that the first retention stud 27 is situated on the left side of the gap 40 (according to FIG. 2) and such that the second driving stud 42 is inclined as if it was moving away from the body of the butterfly such that the second member 10 or upper wing is in its low position, nearest the dial. In this "low" position, the wings of the butterfly seem closed, the first member 8 or lower wing appearing just behind the second member 10 or upper wing.

Figure 5:
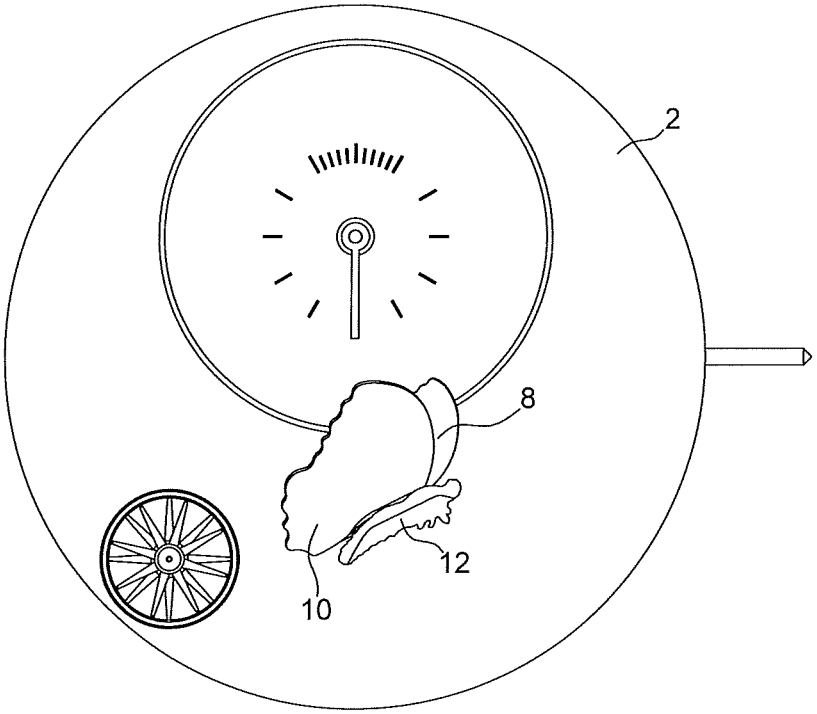
FIG. 5 is a schematic view from above of the timepiece, the upper wing of the butterfly being in an intermediate position.
Figure 6:
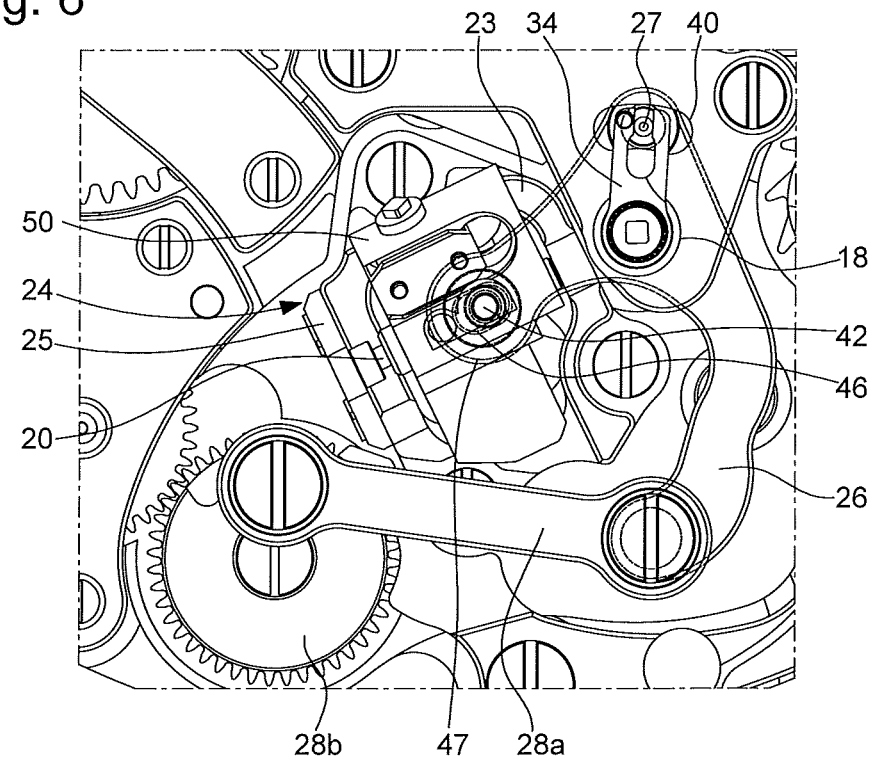
FIG. 6 is a view from above of the driving mechanism of the automaton according to the invention, when the upper wing of the butterfly is in an intermediate position.
Figure 7:
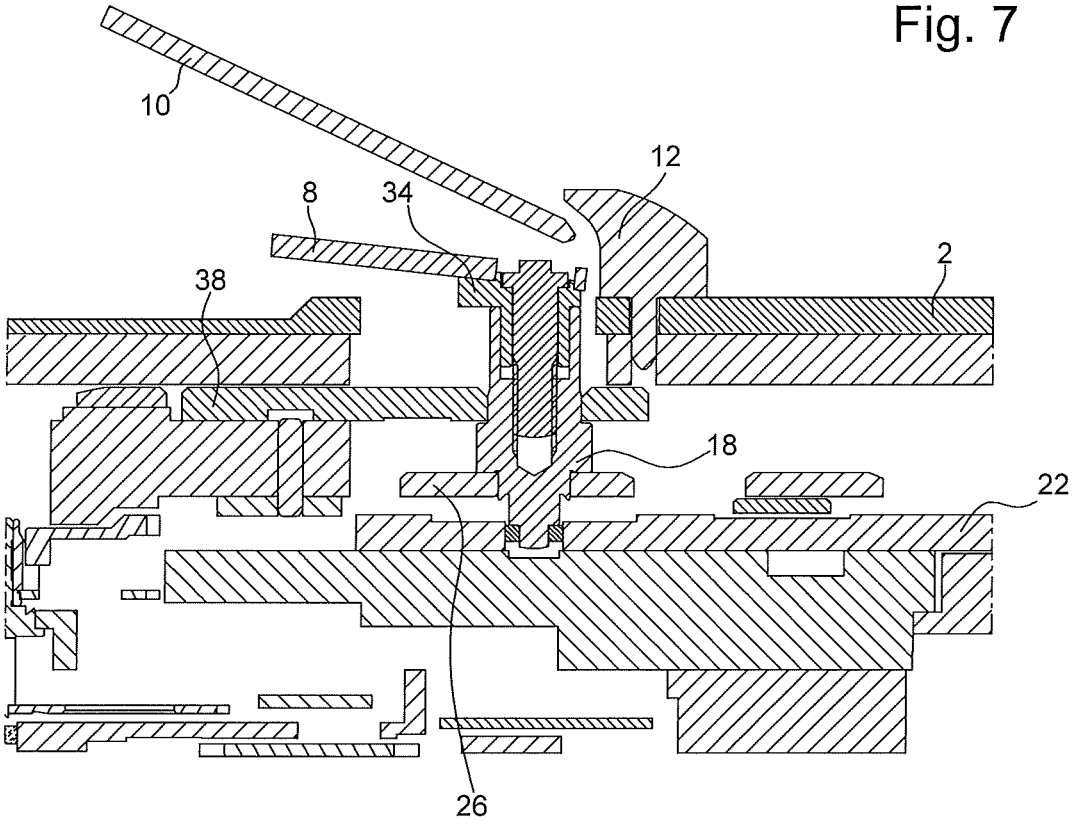
FIG. 7 is a sectional view of the mechanism at the level of the first axis when the upper wing of the butterfly is in an intermediate position.
Figure 8:
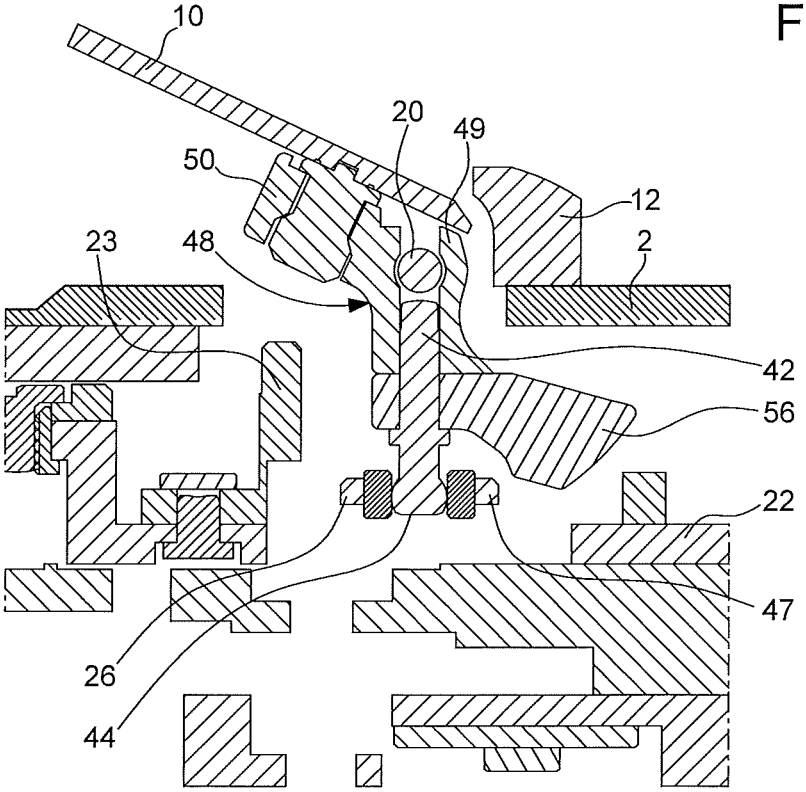
FIG. 8 is a sectional view of the mechanism at the level of the second driving stud when the upper wing of the butterfly is in an intermediate position, more particularly and in a non-limiting manner, when the second driving stud is located in vertical position in the middle of its angular course.

When the push button is actuated, the connecting rod device 28*a*, 28*b* is freed so that the lever 26 pivots about the first axis AA, for example in clockwise direction according to the non-limiting example illustrated here, driving the first member 8 with its retention stud 27 and the second driving stud 42 into intermediate positions, as illustrated in FIGS. 5 to 8. More precisely, the lever 26 pivots, here in clockwise direction, about the first axis AA, in one piece with the first shaft 18, the first member carrier 32 carrying the member 8 or lower wing, and the first retention stud 27 which is displaced into the gap 40. The first retention stud 27, by acting on the first clip 34, makes it possible to secure the system, whilst avoiding unscrewing the first member carrier and absorbing any possible impacts and vibrations which will therefore not be transmitted to the thread. Thus, the first member 8 or lower wing pivots here in clockwise direction to appear advantageously behind the upper wing, as is shown in FIG. 5. In parallel, the free end 47 of the lever 26 is displaced driving the second driving stud 42 by its sphere 44 so that said second driving stud 42 pivots in the gap 46. This pivoting of the second driving stud 42, integral with the socket 49 mounted on the module 24, drives the pivoting of the second member carrier 48 and of its shaft 20 into the module 24 about the second axis BB such that, as is shown in FIG. 8, the counterweight 56 integral with the socket 49 moves away from the body 12, and the second member 10 or upper wing opens, its free end moving away here from the dial, into its intermediate position.

Driven by the connecting rod device 28*a*, 28*b*, the lever 26 continues to pivot about the first axis AA, here in clockwise direction, driving the first member 8 with its retention stud 27 and the second driving stud 42 in order to reach the "high" position, as illustrated in FIGS. 9 to 12.

Figure 9:
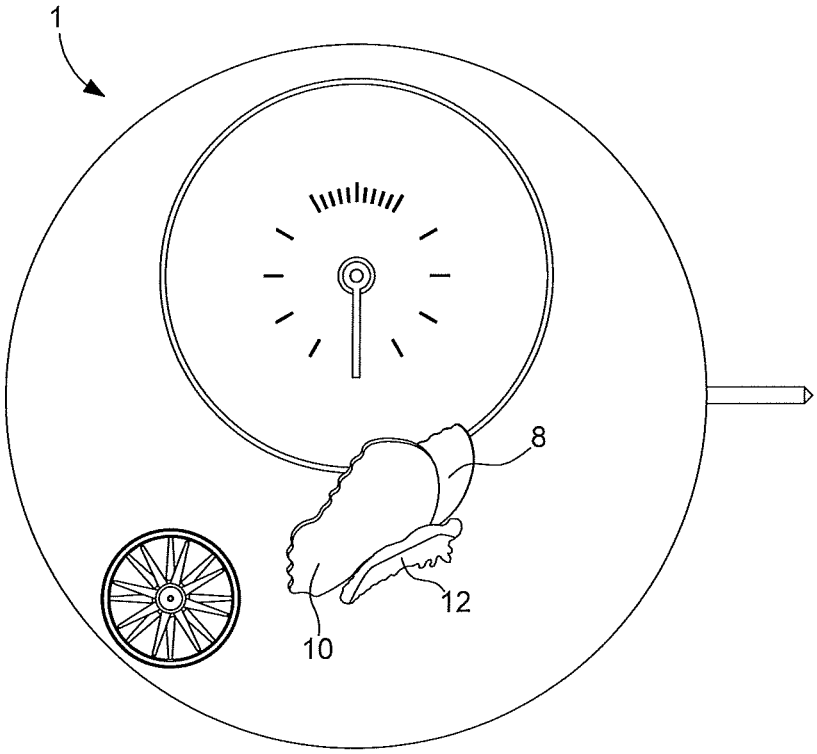
FIG. 9 is a schematic view from above of the timepiece, the upper wing of the butterfly being in its high position.
Figure 10:
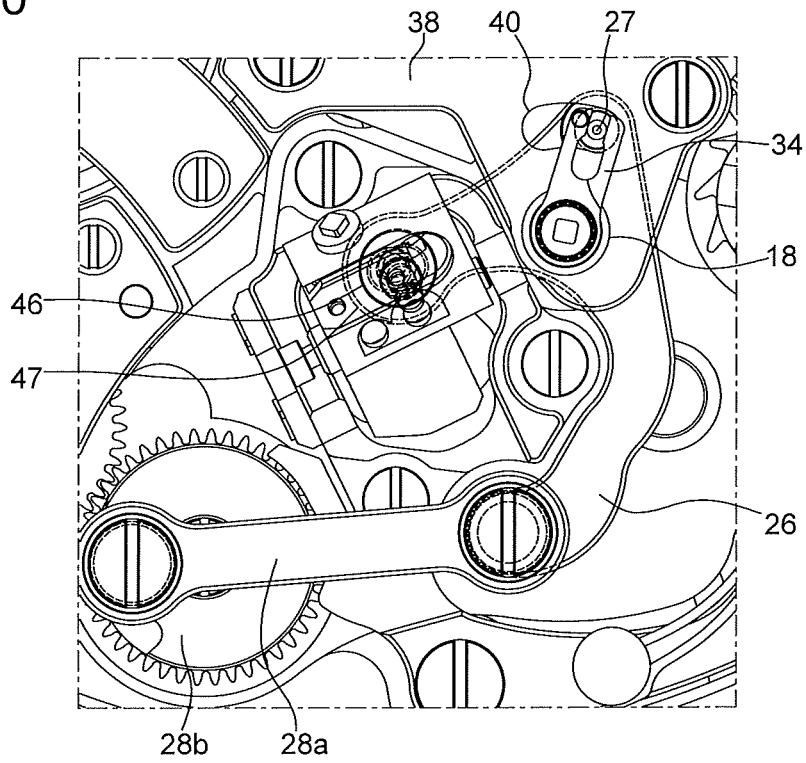
FIG. 10 is a view from above of the driving mechanism of the automaton according to the invention, when the upper wing of the butterfly is in its high position.
Figure 11:
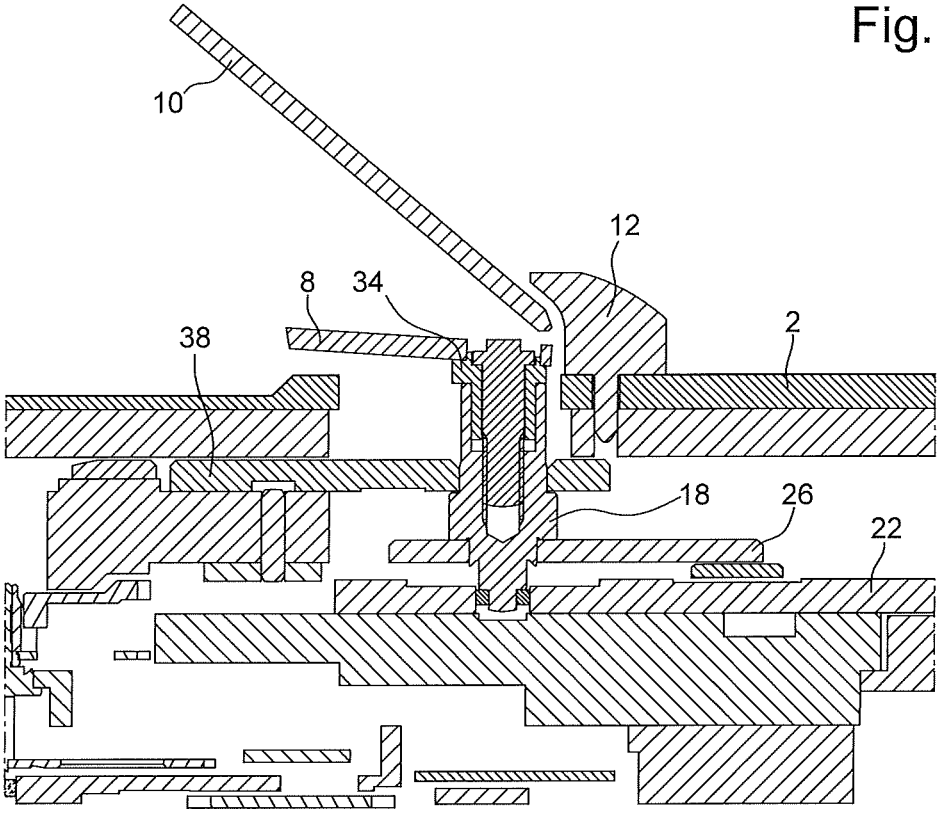
FIG. 11 is a sectional view of the mechanism at the level of the first axis when the upper wing of the butterfly is in its high position.
Figure 12:
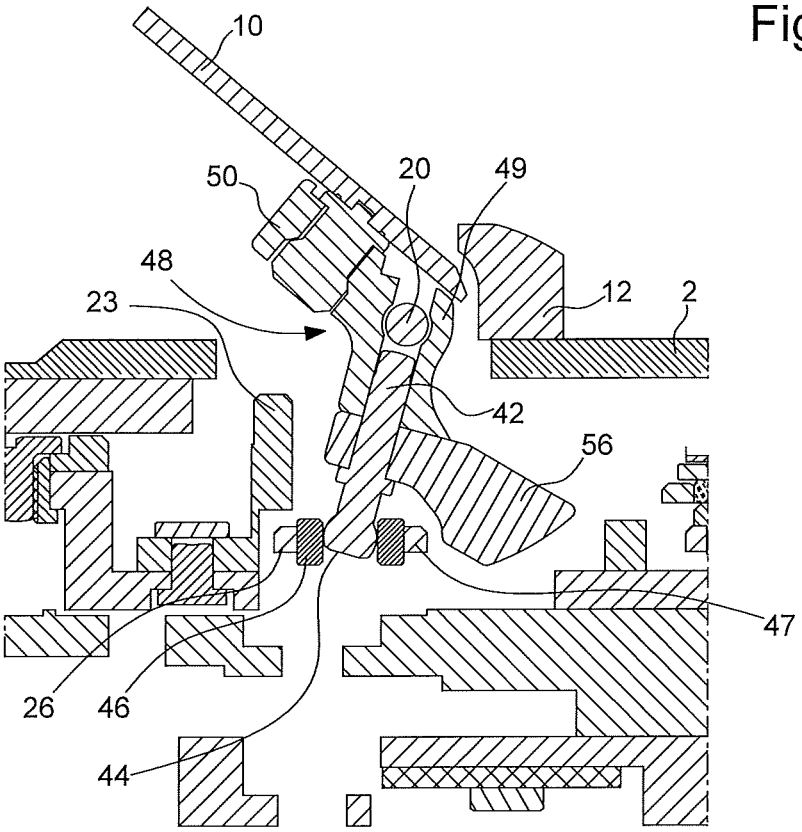
FIG. 12 is a sectional view of the mechanism at the level of the second driving stud when the upper wing of the butterfly is in its high position.

More precisely, the lever 26 continues to pivot in one piece about the first axis AA, and here in clockwise direction, with the first shaft 18, the first member carrier 32, the member 8 or lower wing, and the first retention stud 27 which continues to be displaced freely here in clockwise direction into the gap 40 in order to reach its right side, according to FIG. 10. Hence, the first member 8 or lower wing always pivots here in clockwise direction in order to appear again advantageously behind the upper wing, as shown in FIG. 9. In parallel, the free end 47 of the lever 26 is again displaced driving the second driving stud 42 by its sphere 44 so that said second driving stud 42 continues to pivot into the gap 46. This pivoting of the second driving stud 42, integral with the socket 49 mounted on the module 24, again drives the pivoting of the second member carrier 48 and its shaft 20 into the module 24 about the second axis BB such that, as shown in FIG. 12, the counterweight 56 which is integral with the socket 49 moves away more from the body 12, the second member 10 or upper wing opening more, the free end thereof moving away even more from the dial 2 until reaching its "high" position. This first part of the cycle corresponds to the "opening phase" of the wings of the butterfly according to which the lower wing appears progressively behind the upper wing and the upper wing opens, the outer edge thereof moving away from the dial.

Then still driven by the connecting rod device 28*a*, 28*b*, the lever 26 continues to pivot about the first axis AA but henceforth in anticlockwise direction, as a result of the alternating circular movement, so that the movements described above are reversed in order to bring the first retention stud 27 on the left side of the gap 40 and to bring back the second driving stud 42 so that the counterweight 56 is again here nearest the body 12 of the butterfly. This second part of the cycle corresponds to the "closing phase" of the wings of the butterfly according to which the lower wing disappears progressively behind the upper wing, and the upper wing closes, its outside edge approaching the dial until reaching again its low position. The opening phase and closing phase cycles are linked continuously in order to create an impression of butterfly wings beating until voluntary stoppage of the automaton by pressing on the push button or until there is no longer sufficient power to drive the automaton. The connecting rod device is provided in order to give the first and second members a speed profile of a sinusoidal form during beating, which is adapted perfectly to the movement of the wings of a butterfly, the speeds progressing gradually.

Because of the positioning of the first and second members 8 and 10 and their non-symmetrical pivoting about different axes, the automaton mechanism according to the invention, which is able to reproduce the beating of two members, in order to simulate in particular the beating of wings, is particularly compact. This makes it possible to produce a more visual automaton without impairing the surface which remains available on the dial, which is particularly advantageous when the timepiece is a wristwatch.

The construction according to the invention is likewise particularly advantageous in order to make it possible to use a dial with restricted opening in order to hide, as far as possible, the mechanism for actuating the automaton. In fact, the only elements which pass through the dial are the member carriers. The construction of the invention with a single screw makes it possible to block all the degrees of freedom of the wings once they are made integral with the member carriers. The automaton is produced by assembling firstly the lever 26 with the first shaft 18 between the frame 22 and the intermediate bridge 38, then the rod 28*a* between the connecting rod 28*b* and the lever 26. The second member carrier 48 without the upper wing 10 is assembled in the module 24. Then the dial 2 is fixed on the frame 22, the dial having adjacent openings of dimensions which correspond to the spatial requirement which the first member carrier 32 and the second member carrier 48, including module 24, represent. Then the first member carrier 32 with the lower wing 8 is fixed on the first shaft 18 provided on the lever 26 by means of a screw, preferably with a square head, in order not to risk spoiling the dial 2 and finally the upper wing 10 on the second member carrier 48 by means of a screw, preferably with a square head in order not to risk spoiling the dial. This assembly is necessary in the particular case of the example described here in which the upper wing covers the lower wing at least partially.

The automaton mechanism according to the invention likewise makes it possible to obtain very good efficiency and to have an instantaneous achieved torque which is low and constant. In fact, the automaton mechanism according to the invention comprises no system oscillating by meshing. It has therefore no play and consequently no jolting. The second member is counterbalanced with a counterweight, which counterbalances imbalances. The components of the automaton are therefore not sensitive to spatial positions of the timepiece, in particular when a wristwatch is concerned. Furthermore, it is not necessary to use a return spring, which makes it possible to reduce the torque necessary for transmission, and to have a more constant torque. As an oscillating movement is concerned, the only torque which is necessary is due to acceleration of the components and to their inertia relative to their axis of rotation. This power is provided when the automaton "brakes" upon each oscillation. The only energy consumed is due to passive friction in the pivots, gaps, etc. The lever and the driving studs always operate with an angle composed preferably between 70° and 90° when the course of the second member 10 is 40°, and more preferably between 75° and 90°, when the course of the second member 10 is 30°, which is ideal for transmission. The geometric efficiencies in these limited angles fluctuate between 96 and 100%, the passive torques to be overcome being very low because of the absence of a return spring.

What is claimed is:

1. A timepiece comprising:

a dial defining an XY plane, an automaton disposed above the dial, said automaton having at least one first member and one second member, which are articulated in order to reproduce beating movements, and a driving mechanism of said automaton, wherein the first member is provided in order to pivot about a first axis which is non-parallel to the XY plane and the second member is provided in order to pivot about a second axis which is different from the first axis, wherein the driving mechanism of the automaton comprises actuation means of the first and second members, provided in order to make said first and second members respectively pivot according to non-symmetrical pivoting movements and in order to coordinate said pivoting movements of said first and second members so that the combination thereof gives a beating effect of said first and second members, and wherein the first member is disposed nearest the dial and the second member is disposed furthest away from the dial and has a base which simulates an articulation, the first member being provided in order to pivot in a plane which is perpendicular to the first axis, and the second member being provided in order to pivot about the second axis which is provided coaxially to said base and to oscillate between a low position and a hick position relative to the dial.

2. The timepiece according to claim 1, wherein, in its low position, the second member forms an angle less than 20° with the dial.

3. The timepiece according to claim 2, wherein, in its low position, the second member forms an angle less than 10° with the dial.

4. The timepiece according to claim 1, wherein a course over which the first member rotates and a course over which the second member rotates are less than 40°.

5. The timepiece according to claim 4, wherein the course of the first member and the course of the second member are less than 30°.

6. The timepiece according to claim 1, wherein the first axis is perpendicular to the XY plane and wherein the second axis is positioned in a plane which is substantially parallel to the XY plane.

7. The timepiece according to claim 6, wherein the first axis and the second axis are perpendicular.

8. The timepiece according to claim 1, wherein the actuation means of the first member comprise a lever which is provided in order to pivot about the first axis, said lever being integral with the first member in order to make said first member pivot about the first axis during pivoting of the lever.

9. The timepiece according to claim 8, wherein the first member is fixed to a first member carrier which is provided in order to pivot about the first axis, said first member carrier being integral with the lever.

10. The timepiece according to claim 9, wherein the first member carrier comprises a pipe which is provided in order to pivot about the first axis and to be integral with the lever and a first clip on which the first member rests.

11. The timepiece according to claim 8, further comprising a retention stud which is integral with the lever and with the first member.

12. The timepiece according to claim 8, wherein the actuation means of the second member comprise a driving stud, and the driving stud comprises, at a second end, a sphere which is mounted on the lever by a spherical linkage in order to make the second member oscillate about the second axis during pivoting of the lever about the first axis.

13. The timepiece according to claim 8, wherein the lever is actuated by a connecting rod device which is provided in order to transform a continuous circular movement of a mobile part of the timepiece into an alternating circular movement.

14. The timepiece according to claim 1, wherein the actuation means of the second member comprise a driving stud, a first end of which is integral with the second member and provided in order to make the second member oscillate between its low position and its high position about the second axis.

15. The timepiece according to claim 14, wherein the second member is fixed on a second member carrier which is mounted pivoting about the second axis and integral with the driving stud, said second member carrier comprising a second clip on which the second member is mounted.

16. The timepiece according to claim 15, wherein the second member carrier carries furthermore a counterweight.

17. The timepiece according to claim 1, wherein the automaton represents a butterfly comprising a lower wing, an upper wing and a body, the first member disposed nearest the dial representing the lower wing and the second member disposed furthest away from the dial representing the upper wing, said second member having a base which simulates an articulation of the upper wing with the body of the butterfly.

18. A timepiece comprising:

a dial defining an XY plane, an automaton disposed above the dial, said automaton having at least one first member and one second member, which are articulated in order to reproduce beating movements, and a driving mechanism of said automaton, wherein the first member is provided in order to pivot about a first axis which is non-parallel to the XY plane and the second member is provided in order to pivot about a second axis which is different from the first axis, wherein the driving mechanism of the automaton comprises actuation means of the first and second members, provided in order to make said first and second members respectively pivot according to non-symmetrical pivoting movements and in order to coordinate said pivoting movements of said first and second members so that the combination thereof gives a beating effect of said first and second members, wherein the actuation means of the first member comprise a lever which is provided in order to pivot about the first axis, said lever being integral with the first member in order to make said first member pivot about the first axis during pivoting of the lever, and wherein the timepiece further comprises a retention stud which is integral with the lever and with the first member.

19. A timepiece comprising:

a dial defining an XY plane, an automaton disposed above the dial, said automaton having at least one first member and one second member, which are articulated in order to reproduce beating movements, and a driving mechanism of said automaton, wherein the first member is provided in order to pivot about a first axis which is non-parallel to the XY plane and the second member is provided in order to pivot about a second axis which is different from the first axis, wherein the driving mechanism of the automaton comprises actuation means of the first and second members, provided in order to make said first and second members respectively pivot according to non-symmetrical pivoting movements and in order to coordinate said pivoting movements of said first and second members so that the combination thereof gives a beating effect of said first and second members, wherein the actuation means of the first member comprise a lever which is provided in order to pivot about the first axis, said lever being integral with the first member in order to make said first member pivot about the first axis during pivoting of the lever, and wherein the actuation means of the second member comprise a driving stud, and the driving stud comprises, at a second end, a sphere which is mounted on the lever by a spherical linkage in order to make the second member oscillate about the second axis during pivoting of the lever about the first axis.

* * * * *